US009752567B2

(12) United States Patent
Nakamura

(10) Patent No.: US 9,752,567 B2
(45) Date of Patent: Sep. 5, 2017

(54) TUBING PUMP APPARATUS

(71) Applicant: MIMAKI ENGINEERING CO., LTD., Nagano (JP)

(72) Inventor: Tohru Nakamura, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 425 days.

(21) Appl. No.: 14/366,000

(22) PCT Filed: Dec. 21, 2012

(86) PCT No.: PCT/JP2012/083281
§ 371 (c)(1),
(2) Date: Jun. 17, 2014

(87) PCT Pub. No.: WO2013/094740
PCT Pub. Date: Jun. 27, 2013

(65) Prior Publication Data

US 2014/0363323 A1 Dec. 11, 2014

(30) Foreign Application Priority Data

Dec. 24, 2011 (JP) ..... 2011-282538

(51) Int. Cl.
*F04B 43/08* (2006.01)
*F04B 43/12* (2006.01)

(52) U.S. Cl.
CPC ..... *F04B 43/082* (2013.01); *F04B 43/1261* (2013.01); *F04B 43/1292* (2013.01)

(58) Field of Classification Search
CPC .. F04B 43/12; F04B 43/1238; F04B 43/1253; F04B 43/1292
(Continued)

(56) References Cited

U.S. PATENT DOCUMENTS 5,140,747 A * 8/1992 Barnett ..... B67D 7/58 29/888.022
5,846,061 A * 12/1998 Ledebuhr ..... F04B 43/1292 384/473

FOREIGN PATENT DOCUMENTS

JP 10-238479 9/1998
JP H10-238479 9/1998
(Continued)

OTHER PUBLICATIONS

"International Search Report (Form PCT/ISA/210) of PCT application", mailed on Apr. 2, 2013, with English translation thereof, p. 1-p. 2.

(Continued)

*Primary Examiner* — Patrick Hamo
(74) *Attorney, Agent, or Firm* — Jianq Chyun IP Office

(57) ABSTRACT

A tubing pump apparatus is provided. In the tubing pump apparatus, bearing members are integrally formed through engagement, whereby a first shaft of a support plate is rotatably supported by a first bearing portion of one bearing member, and a second shaft of the support plate is rotatably supported by a second bearing portion of another bearing member arranged side by side with the bearing member. By further adding a bearing member, the first shaft of the support plate provided adjacent thereto is rotatably supported by the first bearing portion of the bearing member, and the second shaft is rotatably supported by a second bearing portion of the other bearing member. In this construction, it is possible to arrange side by side a plurality of tubing pumps in the axial direction of the support plates so that it is possible to achieve a reduction in the size of the whole.

9 Claims, 10 Drawing Sheets

(58) Field of Classification Search
USPC ..... 417/474, 475, 477.3
See application file for complete search history.

(56) References Cited

FOREIGN PATENT DOCUMENTS

| | | |
|---|---|---|
| JP | 2003-021081 | 1/2003 |
| JP | 2004-092602 | 3/2004 |
| JP | 4062865 | 3/2008 |

OTHER PUBLICATIONS

"Office Action of Japan Counterpart Application", issued on Sep. 1, 2015, p. 1-p. 10, with English translation thereof.

* cited by examiner

TUBING PUMP APPARATUS

CROSS-REFERENCE TO RELATED APPLICATION

This application is a 371 of international application of PCT application serial no. PCT/JP2012/083281, filed on Dec. 21, 2012, which claims the priority benefit of Japan application no. 2011-282538, filed on Dec. 24, 2011. The entirety of each of the above-mentioned patent applications is hereby incorporated by reference herein and made a part of this specification.

TECHNICAL FIELD

The present invention relates to a tubing pump apparatus configured to squeeze an elastic tube by a roller to send out a liquid therein.

BACKGROUND ART

FIG. 10 is a schematic diagram illustrating a tubing pump as disclosed in PTL 1. In this tubing pump 500, a pump wheel 502 is provided within a pump frame 501, and a pair of rollers 503 is rotatably provided on this pump wheel 502. Around the rollers 503, there is arranged a tube 504 in an annular fashion. Rotation of a motor (not illustrated) is transmitted via a gear 505, and is adjusted by a rotation retarding mechanism consisting of a ratchet wheel 507 and an intermediate transmission wheel 506 before being transmitted to the pump wheel 502. The ratchet wheel 507 and the intermediate transmission wheel 506 are urged toward the pump wheel 502 by a spring 509. Through the rotation of the pump wheel 502, the rollers 503 move while squeezing the tube 504, whereby a liquid within the tube 504 is sent out.

REFERENCE LIST

Patent Literature

PTL 1: Japanese Patent No. 4062865

SUMMARY OF INVENTION

Technical Problem

In the above conventional tubing pump 500, the pump wheel 502, the rollers 503, and the like which generates a pumping action are provided inside the pump frame 501, so that when a plurality of tubing pumps 500 of the same type are arranged side by side, bulkiness is involved, resulting in an increase in the size of the equipment as a whole in which the tubing pumps are mounted.

It is accordingly an object of the present invention to provide a tubing pump apparatus which involves no bulkiness even when a plurality of tubing pumps are provided side by side and which helps to achieve a reduction in the size of the whole.

Solution to Problem

According to a first aspect of the invention, there is provided a tubing pump apparatus including: a wall surface; an elastic tube which is arranged along the wall surface and the interior of which constitutes a flow path; a squeezing member arranged so as to hold the elastic tube between itself and the wall surface; and a squeezing member support body supporting the squeezing member, a liquid within the elastic tube being transferred by rotating the squeezing member support body so as to cause the squeezing member to move along the wall surface while squeezing the elastic tube, wherein there are provided a pair of bearing portions rotatably supporting the squeezing member support body; there are provided one bearing member equipped with one of the bearing portions, and another bearing member equipped with the other of the bearing portions; and a second bearing portion axially rotatably supporting another squeezing member support body different from the above-mentioned squeezing member support body, which is integrally formed on the one bearing member or the other bearing member.

That is, integrally formed on the one or the other bearing member are the bearing portions rotatably supporting the squeezing member support body, and the second bearing portion axially adjacent thereto and rotatably supporting the other squeezing member support body different from the above-mentioned squeezing member support body. As a result, there is no need to provide a dedicated bearing member for forming the second bearing portion, which means it is possible to achieve a reduction in size in the axial direction corresponding thereto. By extension, it is possible to realize a tubing pump apparatus which is not bulky in the axial direction. The bearing portion and the second bearing portion may be formed integrally and coaxially or integrally with their axes deviated from each other.

According to a second aspect of the invention, there is provided a tubing pump apparatus including: a wall surface; an elastic tube which is arranged along the wall surface and the interior of which constitutes a flow path; a squeezing member arranged so as to hold the elastic tube between itself and the wall surface; a squeezing member support body supporting the squeezing member and having a rotation shaft consisting of a first shaft on one side and a second shaft on the side opposite the first shaft; and a bearing member integrally formed by a first bearing portion rotatably supporting the first shaft of the squeezing member support body, and a second bearing portion rotatably supporting a second shaft of another squeezing member support body provided adjacent to the above-mentioned squeezing member support body, wherein the first shaft of the squeezing member support body is rotatably supported by the first bearing portion of the one bearing member, and the second shaft of the squeezing member support body is rotatably supported by the second bearing portion of the other bearing member provided side by side with the one bearing member; and a liquid within the elastic tube is transferred by rotating the squeezing member support body so as to cause the squeezing member to move along the wall surface while squeezing the elastic tube.

The bearing member is integrally formed by the first bearing portion rotatably supporting the first shaft of the squeezing member support body and the second bearing portion rotatably supporting the second shaft of the other squeezing member support body provided adjacent thereto; thus, by providing the bearing members side by side, the first shaft of the squeezing member support body is rotatably supported by the first bearing portion of the one bearing member, and the second shaft of the squeezing member support body is rotatably supported by the second bearing portion of the other bearing member. That is, it is possible to rotatably support another squeezing member support body while adding a bearing member side by side as needed, so that there is no need to provide a dedicated bearing member for forming the second bearing portion, making it possible to realize a tubing pump apparatus not involving any bulkiness even if the number of tubing pumps is increased.

According to a third aspect of the invention, there is provided a tubing pump apparatus according to the first or second aspect of the invention, wherein the bearing portions of the bearing members are arranged coaxially.

By arranging the bearing portions coaxially, it is possible to reduce the entire tubing pump apparatus in size in the radial direction.

According to a fourth aspect of the invention, there is provided a tubing pump apparatus according to one of the first through third aspects of the invention, wherein the one bearing member has an engagement portion for integral engagement with the other bearing member.

By making the bearing members capable of integral engagement, it is possible to increase the number of tubing pumps by simply adding bearing members.

According to a fifth aspect of the invention, there is provided a tubing pump apparatus according to one of the first through fourth aspects of the invention, wherein the wall surface is integrally formed on the bearing members.

By integrally forming the wall surface with the bearing members, it is possible to achieve a reduction in the number of components.

According to a sixth aspect of the invention, there is provided a tubing pump apparatus according to one of the first through fifth aspects of the invention, wherein the one bearing member and the other bearing member are of the same configuration.

That is, by forming the bearing member provided side by side in the same configuration, the kinds of components are reduced, whereby the production efficiency is enhanced.

According to a seventh aspect of the invention, there is provided a tubing pump apparatus according to one of the first through sixth aspects of the invention, wherein there is provided, between the first shaft of the squeezing member support body and the second shaft of the other squeezing member support body provided adjacent thereto, a connection structure so as to allow transmission of rotation.

In this construction, it is possible to rotate all the squeezing member support bodies by imparting a rotational force to one squeezing member support body, so that it is possible to simplify the structure of the tubing pump apparatus.

According to an eighth aspect of the invention, there is provided a tubing pump apparatus according to one of the first through seventh aspects of the invention, wherein the bearing members have a concave portion and a convex portion which face each other when one bearing member and the other bearing member are arranged side by side in the axial direction; and the elastic tube can be arranged at the concave portion, and the convex portion is arranged so as to face the elastic tube in the vicinity of the opening of the concave portion.

In this configuration, when the bearing members are arranged side by side, the elastic tube is arranged at the concave portion, and is prevented from getting out of the concave portion due to the convex portion, or if allowed to get out of it, can be re-inserted into the concave portion.

Advantageous Effects of Invention

In the tubing pump apparatus according to the invention, no bulkiness is involved if tubing pumps are arranged side by side, making it possible to achieve a reduction in the size of the apparatus as a whole.

DESCRIPTION OF EMBODIMENTS (Embodiment 1)

Figure 1:
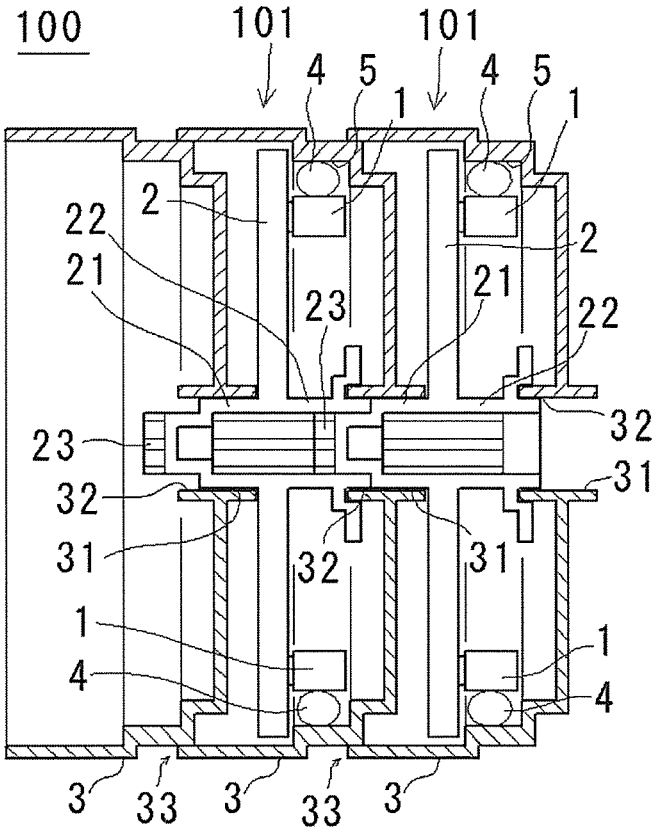
FIG. 1 is a diagram schematically illustrating a tubing pump according to embodiment 1 of the invention.
Figure 2:
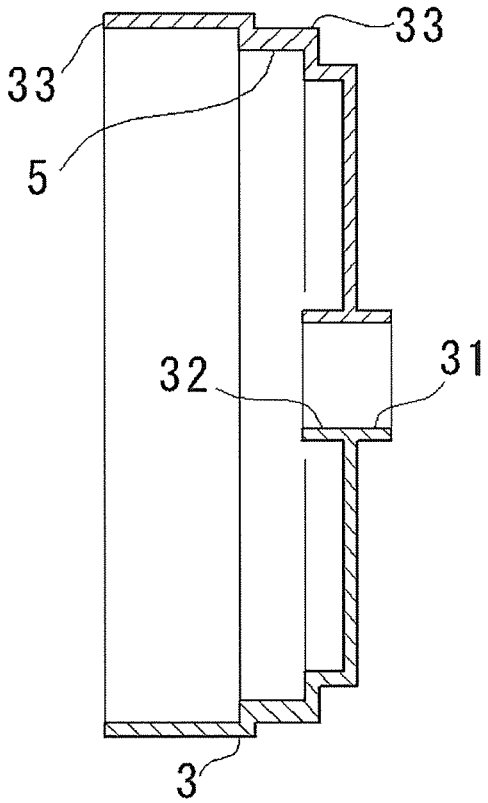
FIG. 2 is a cross-sectional view of a bearing member of the tubing pump shown in FIG. 1.

FIG. 1 is a schematic diagram illustrating a tubing pump apparatus according to embodiment 1 of the invention. FIG. 2 is a sectional view of a bearing member of the tubing pump apparatus shown in FIG. 1. This tubing pump apparatus 100 has a pair of rollers 1 constituting squeezing members squeezing an elastic tube 4, a disc-like support plate 2 constituting a squeezing member support body rotatably supporting the rollers 1, and a bearing member 3 having a first bearing portion 31 and a second bearing portion 32 rotatably supporting a rotation shaft of the support plate 2, wherein a plurality of such bearing members 3 are arranged side by side, with the support plate 2 being arranged in a space defined by the bearing members 3. The first bearing portion 31 and the second bearing portion 32 supporting one support plate 2 are provided in each of the bearing members 3 adjacent to each other.

A first shaft 21 is provided on one side of the support plate 2, and a second shaft 22 is provided on the opposite side. The first shaft 21 and the second shaft 22 constitute the rotation shaft of the support plate 2. As shown in FIG. 2, the bearing member 3 consists of a first bearing portion 31 receiving the first shaft 21 of the support plate 2, and a second bearing portion 32 integrally formed with the first bearing portion and configured to receive the second shaft 22 of the adjacent support plate 2 in the axial direction. That is, the first shaft 21 and the second shaft 22 of the support plate 2 are supported by bearings provided in different bearing members 3 adjacent to each other. The bearing member 3 consists of a cylindrical member, and the first bearing portion 31 and the second bearing portion 32 are formed coaxially and continuously with each other.

The bearing member 3 can be engaged and integrated with another, adjacent bearing member 3 by virtue of an engagement portion 33. As a result, as shown in FIG. 1, the first shaft 21 of the rotation shaft of the support plate 2 is rotatably supported by the first bearing portion 31, and the second shaft 22 is rotatably supported by the second bearing portion 32 of the adjacent bearing member 3.

By engaging and integrating the bearing members 3 with each other, the first shaft of the support plate 2 is rotatably supported by the first bearing portion 31 of the one bearing member 3, and the second shaft of the support plate 2 is rotatably supported by the second bearing portion 32 of the other bearing member 3 arranged side by side with this bearing member 3. Further, as shown in FIG. 1, by further adding a bearing member 3, the first shaft of the support plate 2 provided adjacent thereto is rotatably supported by the first bearing portion 31 of the bearing member 3, and the second shaft is rotatably supported by the second bearing portion 32 of the other bearing member 3. That is, it is possible to add support plate 2 and bearing members 3 one after another.

The first bearing portion 31 and the second bearing portion 32 are formed coaxially, so that the support plate 2 and the adjacent support plate 2 are rotatably supported coaxially. By doing so, it is possible to continuously provide the support plates 2 in the axial direction, so that it is possible to reduce the size of the tubing pump apparatus 100 in the radial direction of the support plates 2.

The second shaft 22 of the support plate 2 and the first shaft 21 of the adjacent support plate 2 can be connected to each other in the rotational direction by a connection structure 23. This connection structure 23 may be of any type so long as it allows transmission of rotation. For example, a cross-shaped convex portion is formed at one end of the first shaft 21, and there is formed at the second shaft 22 a groove portion with which the cross-shaped convex portion is fit-engaged for co-rotation in the rotational direction, whereby the connection structure 23 is formed.

A wall surface 5 is integrally formed on the inner side of the bearing member 3. The elastic tube 4 is arranged along this wall surface 5 on the inner side. Although not shown, the elastic tube 4 is introduced from the tangential direction of a tubular or ring-shaped configuration of the wall surface 5, and makes substantially a half round or ¾ round of the circumference of the wall surface 5 before being drawn out in the tangential direction again. The rollers 1 are situated so as to hold the elastic tube 4 between themselves and the wall surface 5 while rotatably supporting the support plate 2.

As described above, there is formed a tubing pump 101 in which the support plate 2 is arranged between the bearing member 3 and the bearing member 3 integrally engaged therewith, and in which the elastic tube 4 is arranged between the rollers 1 rotatably supported by the support plate 2 and the wall surface 5. And, through the integral engagement of the bearing members 3, it is possible to arrange a plurality of tubing pumps 101 side by side in the axial direction in a desired number.

When the support plates 2 are rotated by a motor (not illustrated), since the support plates 2 are connected by the connection structure 23, it is possible to rotate all the support plates 2 through rotation of one support plate 2. As a result of the rotation of the support plates 2, the elastic tubes 4 are squeezed between the rollers 1 and the wall surfaces 5, with the squeezed portions of the elastic tubes 4 moving along with the movement of the rollers 1. As a result, the liquid within the elastic tubes 4 is transferred so as to be pushed out.

In this tubing pump apparatus 100, the bearing members 3 are integrally engaged with each other by the engagement portions 33, whereby it is possible to arrange side by side a plurality of tubing pumps 101 in the axial direction of the support plates 2 in an efficient manner from the viewpoint of space, so that it is possible to achieve a reduction in the size of the whole without involving any bulkiness. Further, since one kind of bearing member 3 is sufficient, the number of components is reduced, whereby an improvement is achieved in terms of production efficiency.

(Embodiment 2)

Figure 3:
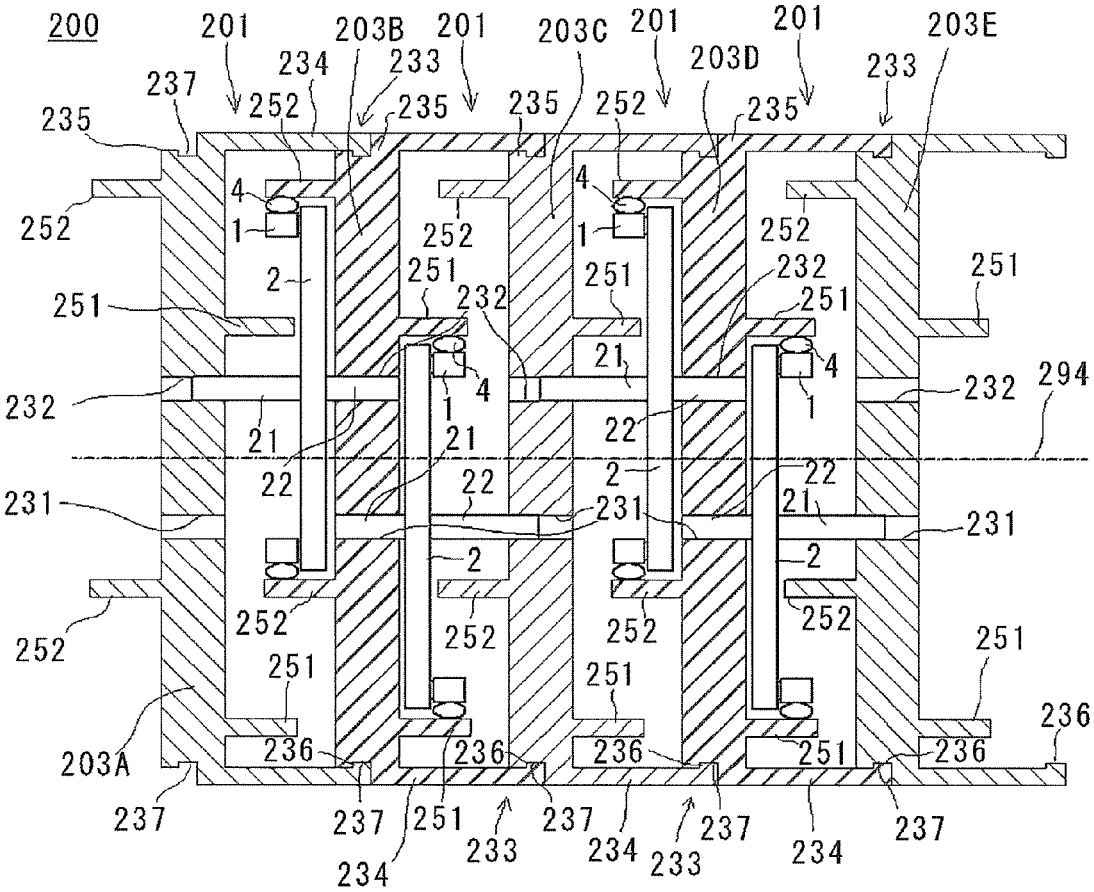
FIG. 3 is a diagram schematically illustrating a tubing pump according to embodiment 2 of the invention.
Figure 4:
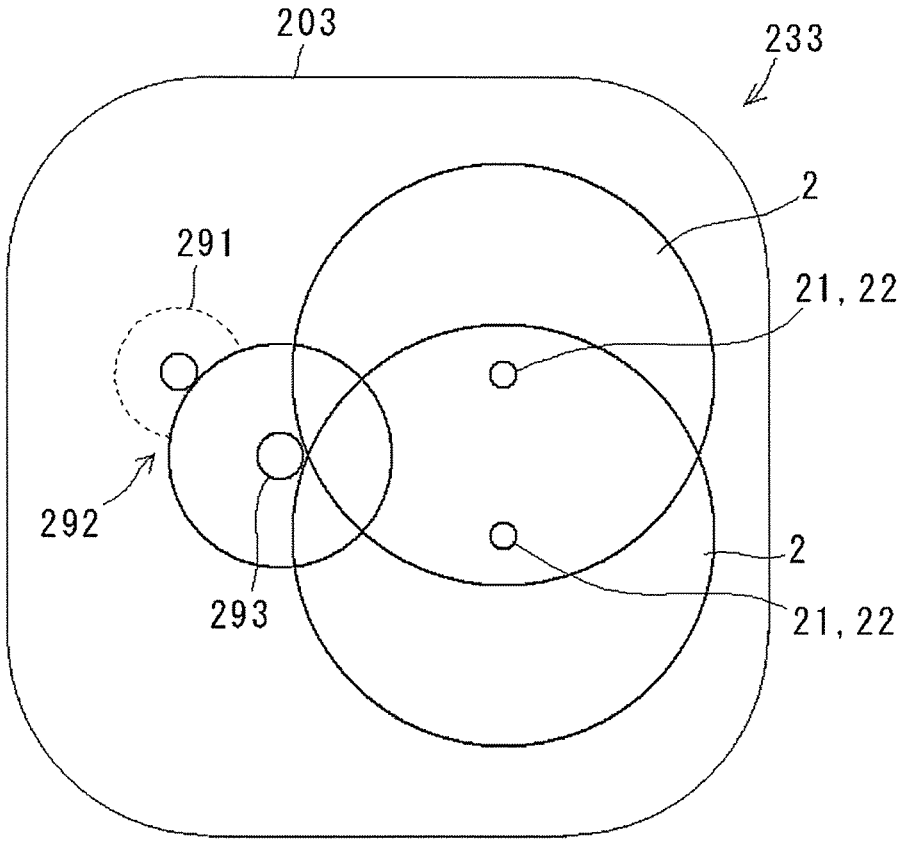
FIG. 4 is a schematic diagram illustrating a modification of the tubing pump according to embodiment 1.

FIG. 3 is a diagram schematically illustrating the tubing pump apparatus according to embodiment 2 of the invention. FIG. 4 is an explanatory view illustrating the arrangement in the axial direction of the components of the tubing pump apparatus shown in FIG. 3. This tubing pump apparatus 200 is characterized in that the first bearing portion 31 and the second bearing portion 32 of the tubing pump apparatus 100 according to embodiment 1 are provided with their axial positions being deviated from each other.

This tubing pump apparatus 200 includes: a pair of rollers 1 constituting squeezing members squeezing an elastic tube 4; a disc-like support plate 2 constituting a squeezing member support body rotatably supporting the rollers 1; and a bearing member 203 having a first bearing portion 231 and a second bearing portion 232 rotatably supporting a rotation shaft of the support plate 2, wherein a plurality of the bearing members 203 are arranged side by side, with the support plate 2 being arranged between the bearing members 203.

Bearing members 203A through 203C will be described by way of example. The bearing member 203B has a first bearing portion 231 receiving a first shaft 21 of the support plate 2, and a second bearing portion 232 receiving a second shaft 22 of another support plate 2 arranged between itself and the adjacent bearing member 203A. The first bearing portion 231 and the second bearing portion 232 are provided at positions different from each other in the axial direction.

The bearing member 203A is integrally engaged with another bearing member 203B at an engagement portion 233. Further, the bearing member 203B can be integrally engaged with another bearing member 203C at the engagement portion 233. A first end portion 234 of each bearing member 203 on the lower side as seen in the drawing has a hook-like convex portion 236 protruding inwards in its periphery, and a second end portion 235 thereof on the upper side as seen in the drawing has a groove 237 in its periphery. The bearing members 203 are integrally engaged with each other by fitting the hook-like convex portion 236 into the groove 237. Thus, the bearing member 203B and the bearing member 203C are integrated with each other through fit-engagement between the hook-like convex portion 236 and the groove 237. Also, regarding the other bearing members, they are also integrated with each other through fit-engagement between the adjacent bearing members.

As a result, as shown in FIG. 3, between the bearing member 203A and the bearing member 203B, the first shaft 21 of the rotation shaft of the support plate 2 is rotatably supported by the second bearing portion 232 of the bearing member 203A, and the second shaft 22 is rotatably supported by the second bearing portion 232 of the other bearing member 203B. Further, between the bearing member 203B and the bearing member 203C, the first shaft 21 of the rotation shaft of the support plate 2 is rotatably supported by the first bearing portion 231 of the bearing member 203B, and the second shaft 22 is rotatably supported by the first bearing portion 231 of the other bearing member 203C. As shown in FIG. 3, this also applies to the bearing members 203C through 203E.

Further, on the first end portion 234 side of each bearing member 203, there is formed a tubular or ring-like first wall surface 251 having its center at the axis of the first bearing portion 231 and protruding. On the second end portion 235 side thereof, there is formed a tubular or ring-like second wall surface 252 having its center at the axis of the second bearing portion 232 and protruding. The elastic tube 4 is arranged along the wall surfaces 251 and 252. Although not shown, the elastic tube 4 is introduced from the tangential direction of the tubular or ring-like configuration of the wall surfaces 251, 252, and is drawn out again in the tangential direction after making substantially a half round or ¾ round of the wall surfaces 251, 252. The rollers 1 are arranged so as to hold the elastic tube 4 between the wall surfaces 251 and 252.

As described above, there is formed a tubing pump 201 in which the support plate 2 is arranged between the adjacent bearing members 203, and in which the elastic tube 4 is arranged between the rollers 1 rotatably supported by the support plate 2 and the wall surfaces 251 and 252. And, in this tubing pump 201, by integrally engaging the bearing members 203 with each other, it is possible to arrange a desired number of tubing pumps 201 side by side in the axial direction.

Further, teeth are provided in the outer periphery of each support plate 2, and, as shown in FIG. 4, the teeth in the outer periphery are in mesh with a pinion gear 293 being reduced in speed through a reduction gear 292 in the speed of the rotation of a motor 291 (In FIG. 3, the rotation shaft 294 of the pinion gear 293 is indicated by a chain dotted line). The rotation of this pinion gear 293 is transmitted to each support plate 2, and each support plate 2 is driven to rotate.

Through the rotation of the support plates 2 by the motor 291, the elastic tubes 4 are squeezed between the wall surfaces 251 and 252, and, with the movement of the rollers 1, the squeezed portions of the elastic tubes 4 also move. As a result, the liquid within the elastic tubes 4 is transferred so as to be squeezed out.

As in embodiment 1, also in the above tubing pump 200, no bulkiness is involved even if a plurality of tubing pumps 201 are continuously provided in a great number in the axial direction of the support plates 2, making it possible to achieve a reduction of the size of the entire apparatus. Further, one kind of bearing member 203 is sufficient, which helps to achieve a reduction in the number of components.

Embodiments

Figure 5:
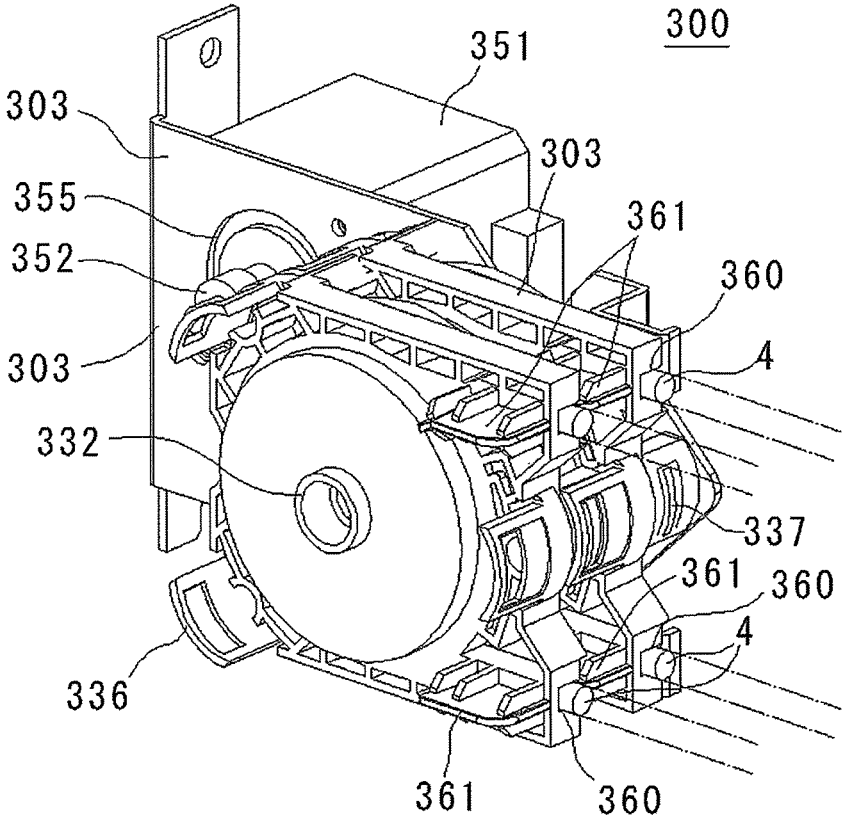
FIG. 5 is a perspective view of a tubing pump apparatus according to the invention.
Figure 6:
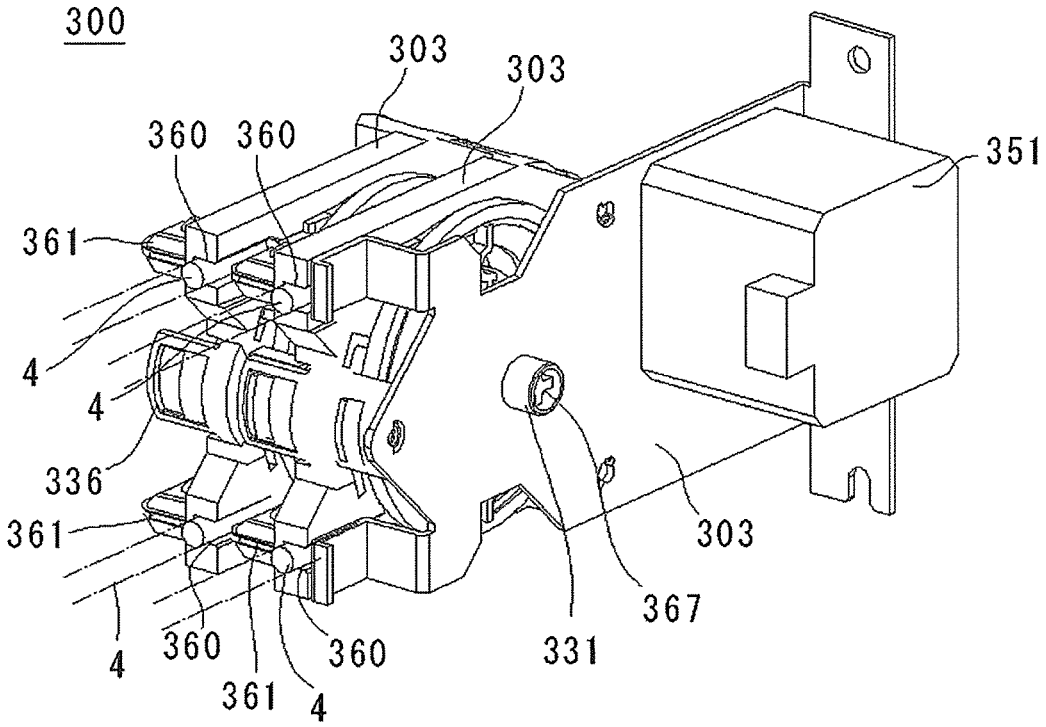
FIG. 6 is a perspective view of the tubing pump apparatus according to the invention.
Figure 7:
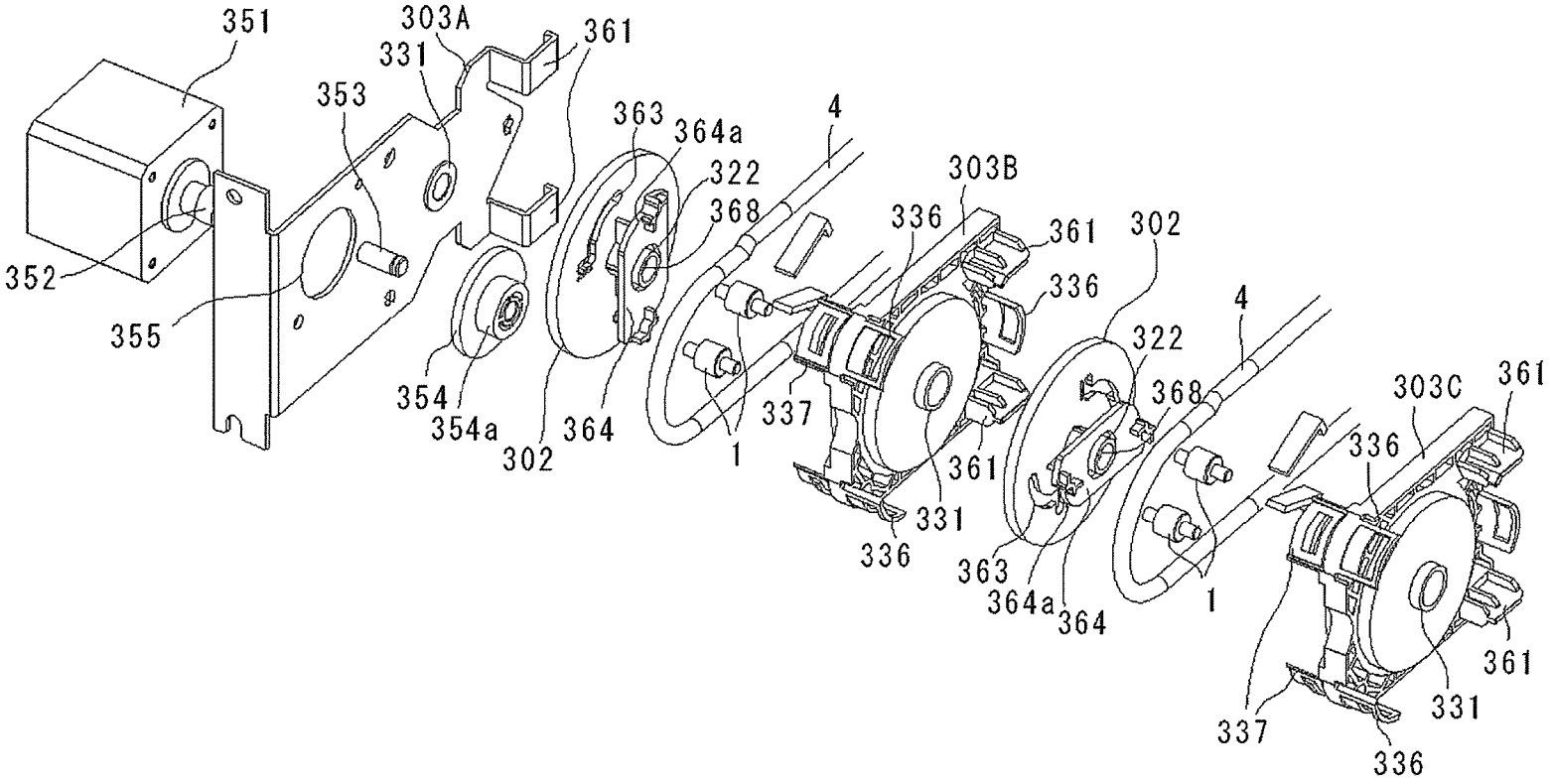
FIG. 7 is an exploded view of the tubing pump apparatus.
Figure 8:
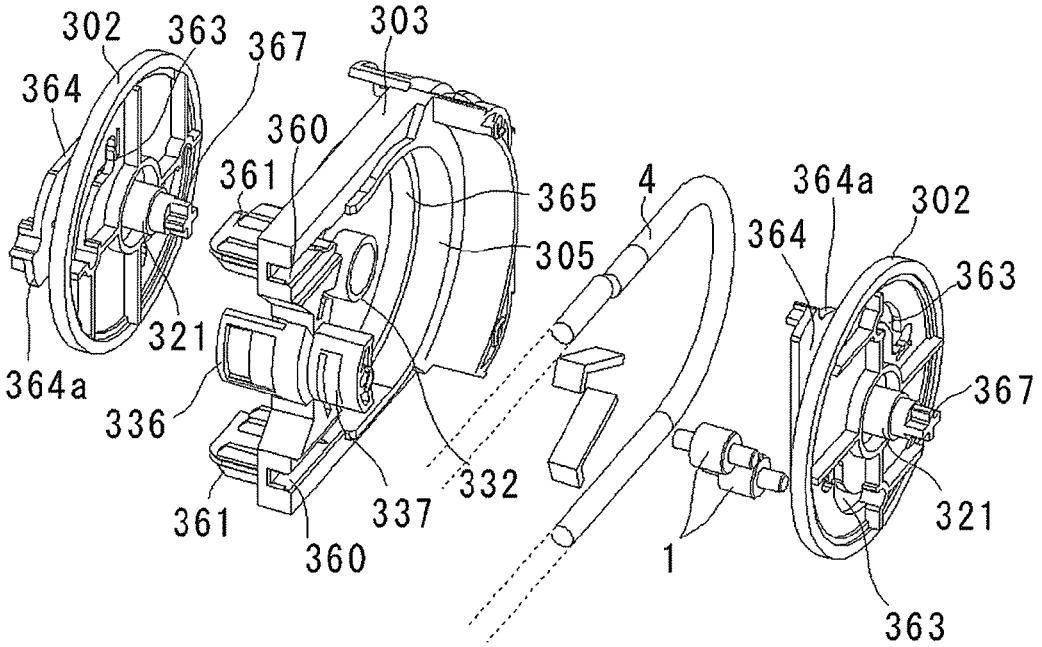
FIG. 8 is an exploded view of a part of the components shown in FIG. 7.

FIGS. 5 and 6 are perspective views of a tubing pump apparatus according to the invention. FIG. 7 is an exploded view of the tubing pump apparatus. FIG. 8 is an exploded view of a part of the components shown in FIG. 7. This tubing pump apparatus 300 has: a bearing member 303A formed of a metal plate; and two bearing members 303B and 303C which are resin moldings and which are arranged side by side in the axial direction. The bearing member 303A, formed of a metal plate, has, at its center, a first bearing portion 331, a mounting hole 355 for mounting a motor 351, and a shaft 353 of a speed reduction gear 354. The motor 351 is mounted with the motor shaft passed through the mounting hole 355. The motor shaft is provided with a pinion gear 352. Further, rotatably supported by the shaft 353 is the speed reduction gear 354 in mesh with the pinion gear 352.

As shown in FIG. 8, the bearing members 303B and 303C consisting of resin moldings have an annular wall surface 305 inside, and this wall surface 305 is of an annular configuration corresponding to substantially a half circle. The elastic tube 4 is arranged along this wall surface 305 so as to be in contact therewith. Further, at a portion extending tangentially from the end of the wall surface 305, there is formed a concave portion 360 which the elastic tube 4 is inserted to be fixed therein. On the surface of the side opposite to the side where the concave portion 360 is formed, there is formed a presser portion 361 consisting of a convex portion pressing the elastic tube 4. The relationship between the elastic tube 4, the concave portion 360, and the presser portion 361 will be described below.

At three portions of the bearing members 303B, 303C, there are formed hooks 336 and grooves 337 to which the hooks 336 are locked. When integrally engaging the bearing members 303 with each other, the hooks 336 of the bearing member 303B are fitted into and engaged the grooves 337 of the bearing member 303C arranged side by side.

A first bearing portion 331 and a second bearing portion 332 of the bearing members 303B, 303C are formed integrally, continuously, and coaxially, forming a sleeve-like configuration as a whole.

A support plate 302 rotatably supports rollers 1. Each roller 1 is of a structure in which a rotation shaft protrudes from both ends of a columnar member. Formed in the support plate 302 is a bearing of a rotation shaft by an arced elongated hole 363 regulating the rollers 1 so as to allow them to move in a desired path, and an end portion 364*a* of a guide plate 364. The distance between the guide plate 364 and the support plate 302 is somewhat larger than the width of the rollers 1. The end portion 364*a* of the guide plate 364 is opposite to a guide surface 365 adjacent to the wall surface 5 of the support plate 302 to form an arced bearing which is substantially the same as the above-mentioned elongated hole 363.

Teeth are formed in the periphery of the support plate 302. These teeth are in mesh with a small diameter gear 354*a* of the speed reduction gear 354. A connection convex portion 367 provided on the first shaft 321 of the support plate 302 is of a cross-shaped configuration, and a connection concave portion 368 provided in the second shaft 322 of the adjacent support plate 302 is a cross-shaped hole corresponding to the cross-shaped configuration.

The tubing pump apparatus 300 is assembled as follows. The speed reduction gear 354 is fitted into the shaft 353 of the bearing member 303A consisting of a metal plate, and then the first shaft 321 of the support plate 302 is passed through the first bearing portion 331. Next, the pair of rollers 1 is rotatably supported by the bearings of the support plate 302. Further, the elastic tube 4 is arranged along the wall surface 305 of the bearing member 303B consisting of resin molding, and the elastic tube 4 is fitted into the concave portion 360.

Then, the second shaft 322 of the support plate 302 is inserted into the second bearing portion 332 of the bearing member 303 to be thereby rotatably supported, and the bearing member 303B is mounted to the bearing member 303A. The mounting to the bearing member 303A consisting of a metal plate is performed by a screw or the like. In this state, the support plate 302 is rotatably supported in the space between the bearing members 303, and the rollers 1 hold the elastic tube 4 between themselves and the wall surface 305.

Similarly, a pair of rollers 1 is rotatably supported by the adjacent support plate 302. Next, the elastic tube 4 is arranged along the wall surface 305 of the bearing member 303B consisting of a resin molding, and the elastic tube 4 is fitted into the concave portion 360. Further, the second shaft 322 of the support plate 302 is inserted into the second bearing portion 332 of the bearing member 303B to be thereby rotatably supported, and the bearing member 303B is mounted to the bearing member 303C. The bearing members 303 are integrated by the engagement portion 333. In this state, the support plate 302 is rotatably supported in the space between the bearing members 303, and the rollers 1 hold the elastic tube 4 between themselves and the wall surface 305.

The connection convex portion 367 provided at the first shaft 321 of the support plate 302 is fitted into the connection concave portion 368 of the second shaft 322 of the adjacent support plate 302, and the rotation shafts of both support plates 302 are mutually connected. The rotation of the support plate 302 is transmitted to the support plate 302 via this connection structure. Thus, when one support plate 302 is rotated by the motor 351, all the support plates 302 are rotated.

When the support plates 302 rotate, the rollers 1 move along the wall surface 305 while squeezing the elastic tubes 4, the liquid within the elastic tubes 4 is transferred so as to be squeezed out.

Further, although not shown, it is possible for another support plate 302 and another bearing member 303 to be further added so as to be arranged side by side in the axial direction. In this case, the assembly is performed by the above procedures, and the components used such as the support plate 302, the rollers 1, and the bearing member 303 can be the same as those described above.

In this tubing pump apparatus 300, it is possible to increase the number of tubing pumps 301 by arranging the bearing members 303 side by side in the axial direction, so that it is possible to achieve a reduction in the size of the entire apparatus without involving any bulkiness.

Figure 9A:
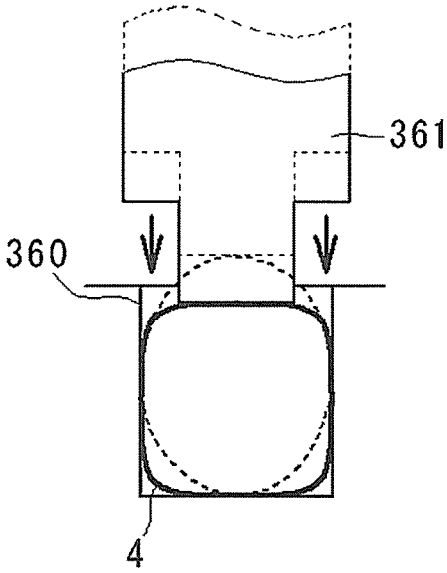
FIGS. 9A and 9B are explanatory views illustrating the relationship between an elastic tube and a holding portion consisting of a concave portion and a convex portion.
Figure 9B:
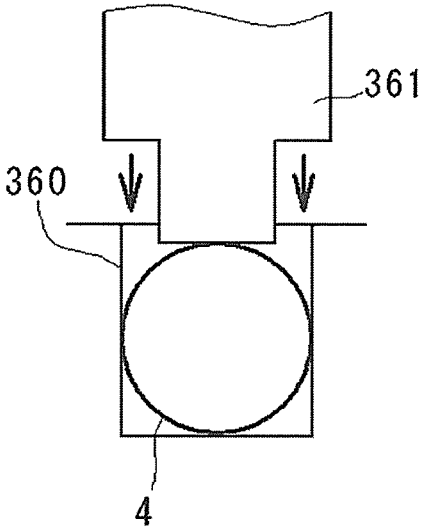
Figure 10:
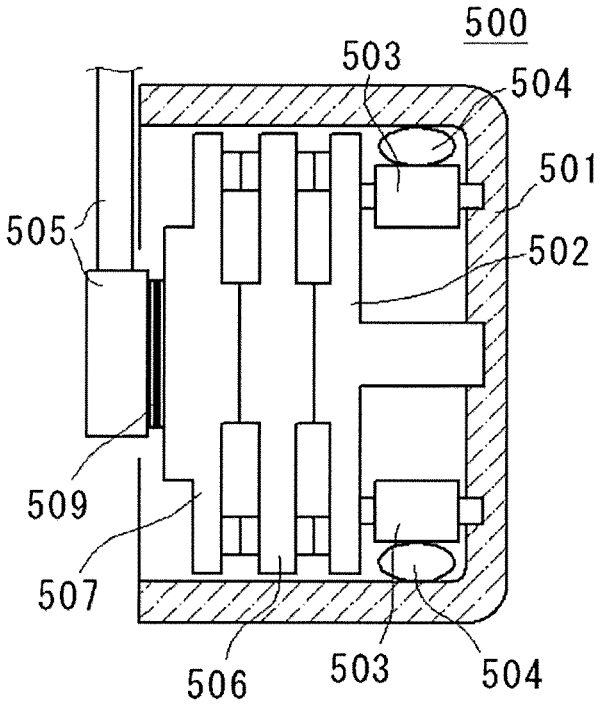
FIG. 10 (PRIOR ART)
FIG. 10 is a diagram schematically illustrating a conventional tubing pump.

FIGS. 9A and 9B are explanatory views illustrating the relationship between the elastic tube and the holding portion consisting of a concave portion and a protrusion. As shown in FIG. 9A, when the diameter of the elastic tube 4 is larger than the width of the concave portion 360, there is no possibility of the elastic tube 4 entering the concave portion 360 of its own accord, so that it is possible for the assembly operator to visually recognize that the elastic tube 4 has not been accommodated in the concave portion 360. Thus, the assembly operator positively pushes the elastic tube 4 into the concave portion 360 to thereby integrate the bearing member 303 through engagement. Further, through engagement between the bearing members 303, the presser portion 361 is situated so as to cover the concave portion 360, and the elastic tube 4 pushed in is pressed, so that there is no fear of the elastic tube 4 being detached from the concave portion 360 due to vibration, etc. during use. Thus, there is no fear of the elastic tube 4 being detached to suffer damage by the gear portion of the support plate 302, etc.

As shown in FIG. 9B, when the diameter of the elastic tube 4 is not more than the width of the concave portion 360, even if the elastic tube 4 is detached during assembly, it can be inserted into the concave portion 360 again by pressing the elastic tube 4 by the presser portion 361. Further, through engagement between the bearing members 303, the presser portion 361 is situated so as to cover the concave portion 360, and presses the elastic tube 4 pushed in, so that there is no fear of the elastic tube 4 from being detached from the concave portion 360 due to vibration or the like during use. Thus, there is no fear of the elastic tube 4 being detached to suffer damage by the gear portion of the support plate 302, etc.

The invention claimed is:

1. A tubing pump apparatus comprising;

a wall surface;

an elastic tube which is arranged along the wall surface and the interior of which constitutes a flow path;

a first squeezing member arranged so as to hold the elastic tube between itself and the wall surface; and a first squeezing member support body supporting the first squeezing member, a liquid within the elastic tube being transferred by rotating the first squeezing member support body; so as to cause the first squeezing member to move along the wall surface while squeezing the elastic tube, wherein there is provided a first pair of bearing portions rotatabiy supporting the first squeezing member support body;

there is provided a first bearing member equipped with one bearing portion of the first pair of bearing portions, and a second bearing member equipped with the other bearing portion of the first pair of bearing portions; and wherein there is provided a second pair of bearing portions, and one bearing portion of the second pair of bearing portions axially rotatably supporting a second squeezing member support body, which is integrally formed on the first bearing member or second bearing member; wherein the wall surface is integrally formed on the bearing members.

2. A tubing pump apparatus comprising:

a wall surface;

an elastic tube which is arranged along the wall surface and the interior of which constitutes a flow path;

a squeezing member arranged so as to hold the elastic tube between itself and the wall surface;

a plurality of squeezing member support bodies supporting the squeezing member and having a rotation shaft consisting of a first shaft on one side and a second shaft on the side opposite the first shaft, and the squeezing member support body having a support plate which is hold by the first shaft and the second shaft; and a plurality of bearing members integrally formed by a first bearing portion rotatably supporting a first shaft of a first squeezing member support body of the plurality of squeezing member support bodies, and a second bearing portion rotatably supporting a second shaft of a second squeezing member support body provided adjacent to the first squeezing member support body of the plurality of squeezing member support bodies, wherein the first shaft of the first squeezing member support body is rotatably supported by a first bearing portion of a first bearing member of the plurality of bearing members, and a second shaft of the first squeezing member support body is rotatably supported by a second bearing portion of a second bearing member provided side by side with the first bearing member, in the plurality of bearing member; and wherein the wall surface is formed on the bearing members, and a first shaft of the first squeezing member support body and a second shaft of the second squeezing member support body are engaged with a portion of the wall surface of the bearing members, a liquid within the elastic tube is transferred by rotating the plurality of squeezing member support bodies so as to cause the squeezing member to move along the wall surface while squeezing the elastic tube.

3. The tubing pump apparatus according to claim 1, wherein the bearing portions of the bearing members are arranged coaxially.

4. The tubing pump apparatus according to claim 1, wherein the first bearing member has an engagement portion for integral engagement with the second bearing member.

5. The tubing pump apparatus according to claim 2, wherein the wall surface is integrally formed on the bearing members.

6. The tubing pump apparatus according to claim 1, wherein the first bearing member and the second bearing member are of the same configuration.

7. The tubing pump apparatus according to claim 2, wherein there is provided, between the first shaft of the squeezing member support body and the second shaft of the other squeezing member support body provided adjacent thereto, a connection structure so as to allow transmission of rotation.

8. The tubing pump apparatus according to claim 1, wherein the bearing members have a concave portion and a convex portion which face each other when first bearing member and the second bearing member are arranged side by side in the axial direction; and the elastic tube can be arranged at the concave portion, and the convex portion is arranged so as to face the elastic tube in the vicinity of the opening of the concave portion.

9. The tubing pump apparatus according to claim 2, wherein the bearing members have a concave portion and a convex portion which face each other when one bearing member and an other bearing member are arranged side by side in the axial direction; and the elastic tube can be arranged at the concave portion, and the convex portion is arranged so as to face the elastic tube in the vicinity of the opening of the concave portion.

* * * * *